US005979696A

United States Patent [19]

Bode et al.

[11] Patent Number: 5,979,696

[45] Date of Patent: Nov. 9, 1999

[54] PACKAGING CONTAINER

[75] Inventors: Jens Bode, Duesseldorf; Lutz Mehlhorn, Krefeld; Georg Muehlhausen, Duesseldorf, all of Germany

[73] Assignee: Henkel-Ecolab GmbH & Co. OHG, Duesseldorf, Germany

[21] Appl. No.: 09/029,681

[22] PCT Filed: Aug. 22, 1996

[86] PCT No.: PCT/EP96/03694

§ 371 Date: Mar. 19, 1998

§ 102(e) Date: Mar. 19, 1998

[87] PCT Pub. No.: WO97/08058

PCT Pub. Date: Mar. 6, 1997

[30] Foreign Application Priority Data

Aug. 31, 1995 [DE] Germany ..... 195 32 041

[51] Int. Cl.[6] ..... B65D 37/00

[52] U.S. Cl. ..... 220/675; 220/669; 215/382

[58] Field of Search ..... 220/669, 675; 215/3, 11.1, 381, 382, 383, 384, 900

[56] References Cited

U.S. PATENT DOCUMENTS

| | | | |
|---|---|---|---|
| 3,325,031 | 6/1967 | Singier | 215/382 X |
| 4,582,227 | 4/1986 | Kanfer | 222/153 |
| 4,600,130 | 7/1986 | Libit | 222/209 |
| 5,000,354 | 3/1991 | Lee et al. | 222/213 |
| 5,303,833 | 4/1994 | Hayashi et al. | 215/381 |
| 5,735,420 | 4/1998 | Nakamaki et al. | 220/675 X |
| 5,833,115 | 11/1998 | Eiten | 215/382 X |
| 5,868,272 | 2/1999 | Deal | 220/669 |

FOREIGN PATENT DOCUMENTS 0 061 522 10/1982 European Pat. Off. .

*Primary Examiner*—Steven Pollard

*Attorney, Agent, or Firm*—Ernest G. Szoke; Wayne C. Jaeschke; Kenneth Watov

[57] ABSTRACT

A packing container for liquid products comprises a closure which opens and closes automatically when the pressure in the container varies, such that the container is easy to handle irrespective of its filling level and can be reliably secured to a wall or the like. The container also includes at least one flat side wall for securing it to a flat surface, and at least one concave or convex actuation surface in the region of opposing side walls such that the user can apply manual pressure.

2 Claims, 1 Drawing Sheet

PACKAGING CONTAINER

BACKGROUND 1.0 Field of the Invention

This invention relates to a container for packaging liquid products, and more specifically to such a container that includes a closure which opens and closes automatically in the event of changes in pressure in the container.

2.0 Discussion of Related Art

Packaging containers in the field of the invention, for example in bottle form, are known. These packaging containers are provided, for example, with a membrane closure which opens when the pressure in the container increases and which automatically closes again when the pressure in the container falls. To produce the increase in pressure, the side walls of the container have to be subjected to pressure so that the packaging container has to be made sufficiently flexible. Unfortunately, the effect of this is that the container is relatively difficult to handle, particularly if it is partly empty. In addition, a container of the type in question is difficult to keep upright or fix to a wall, for example where it is used in toilets as a liquid soap dispenser.

3.0 Summary of the Invention

An object of the present invention is to provide an improved container for liquid products that is easy to handle at all liquid levels, and can be easily mounted on a wall or flat surface.

In one embodiment of the invention, the container has at least one flat side wall for attaching it to a flat surface, and at least one concave or convex actuation surface formed in its side walls to enable pressure to be applied by the hand of the user.

A packaging container designed in this way is easy to handle and easy to attach to a wall or the like. Thus, it may be bonded to a flat wall, for example through its flat surface, or may be placed in a stand or in a wall-mounted holder, the at least one flat surface ensuring that the container is unable to rotate in the holder or stand. The container is arranged with its closure underneath so that, whatever the filling level, liquid product is always present in the vicinity of the closure so that, by applying pressure to the actuation surface, the pressure in the container increases and the product can be dispensed. The controlled actuation by application of pressure to the actuation surface prevents the container from becoming unstable.

To facilitate handling, at least two actuation surfaces located on two opposite side walls are preferably provided.

In one particularly preferred embodiment, the walls of the container are thinner in the region of the actuation surfaces than elsewhere. The wall thickness of the container may thus advantageously be selected so that the container is basically stable and its side wall can only be indented or pushed inward in the vicinity of the actuation surfaces by normal application of pressure.

To increase its stability and to enable it to be easily fixed in a wall-mounted holder or a stand, the container is provided with encircling profiles for insertion into a wall-mounted holder or a stand.

In another preferred embodiment, the container has a rectangular cross-section with a rounded front wall. The combination of this rounded front wall with flat side walls creates a decorative surface which can be seen from all three visible sides. In addition, the fact that the flat rear wall is fixed to a wall surface by adhesive bonding thereto or anchoring in a wall-mounted holder protects the container from bulging when pressure is applied to the actuation surfaces. Another advantage of this cross-sectional form lies in the combination of the advantages of rectangular and circular shapes, i.e. on the one hand there is the isomodular (rectangular) form while, on the other hand, an optimally squeezable bottle (rounded part) is available.

BRIEF DESCRIPTION OF THE DRAWINGS

The invention is described by way of example in the following with reference to the accompanying drawings, in which like items are identified by the same reference designation, wherein.

DETAILED DESCRIPTION OF THE INVENTION

Figure 3:
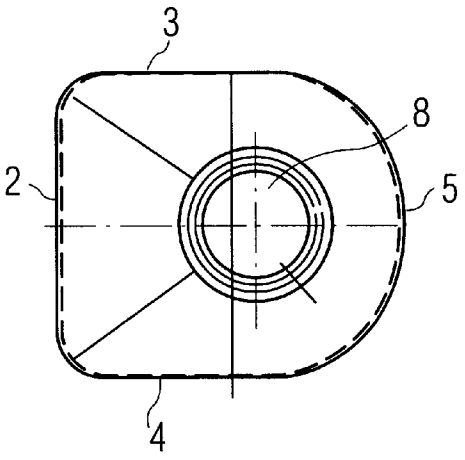
FIG. 3 is a plan view of the container shown in FIG. 1.

A packaging container according to the invention for liquid products is globally denoted by the reference 1 in the drawings. This packaging container is suitable, for example, for accommodating liquid soap and has a substantially rectangular cross-section, the rear wall 2 being flat. The rear wall 2 is adjoined substantially at right angles by two preferably substantially flat side walls 3 and 4 which merge at their ends into a rounded partly cylindrical front wall 5.

The cross-section of the container 1, starting from a bottom wall 6, does not really change over the height of the container 1. At their upper ends, however, the walls 2, 3, 4 and 5 merge via sloping portions 7 into a container opening with a membrane closure denoted by the reference 8. This membrane closure 8 is preferably a membrane closure known in the prior art which enables the product to flow out from the container 1 when the pressure inside the container increases, but which closes when the pressure in the container deceases. The closure 8 may be additionally provided with a protective in-transit cap denoted by the reference 9.

Two convex or concave actuation surfaces 10 (shown as concave compression recesses 10 in the drawing) are preferably provided opposite one another at the same height in the two side walls 3 and 4. The actuation surfaces 10 are preferably thinner than the rest of the container 1 so that the container 1 can be pressed in with light force at the actuation surfaces 10. The wall thickness of the container elsewhere is selected so that light force is not sufficient to deform the container. Profiling 11 in the form of grooves or the like is provided to increase stability.

The rear wall 2 of the container 1 can be provided with an adhesive coating to enable the container 1 to be readily fixed to a wall. The adhesive coating may be formed, for example, by a double-sided adhesive tape, in which case the side remote from the container 1 is provided with a protective film which is designed to be peeled off by the user before the container 1 is fixed to the wall. Instead of adhesive tape, it is possible to use Velcro tape or the like. The container 1 is fixed to the wall in such a way that the closure 8 is situated underneath, i.e. the container 1 is fixed to the wall upside-down. The design of the container 1 and the attachment of the flat rear wall 2 to a wall combine to provide a stable container 1 which does not bulge even when pressure is applied. If product is to be removed, pressure is applied to the two actuation surfaces 10 by the hand of the user so that the internal volume of the container 1 decreases and the pressure in the container rises, causing product to flow out from the container through the membrane valve of the closure 8. This is independent of the filling level of the container 1 because the stability of the container 1 ensures that pressure is reliably built up through controlled depression of the actuation surfaces 10.

Figure 2:
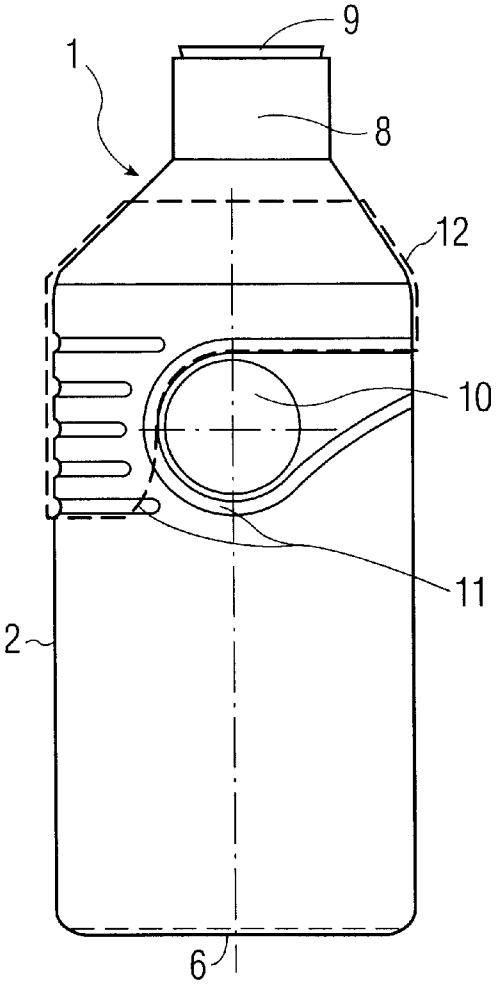
FIG. 2 is a side view of the container shown in FIG. 1.
Figure 1:
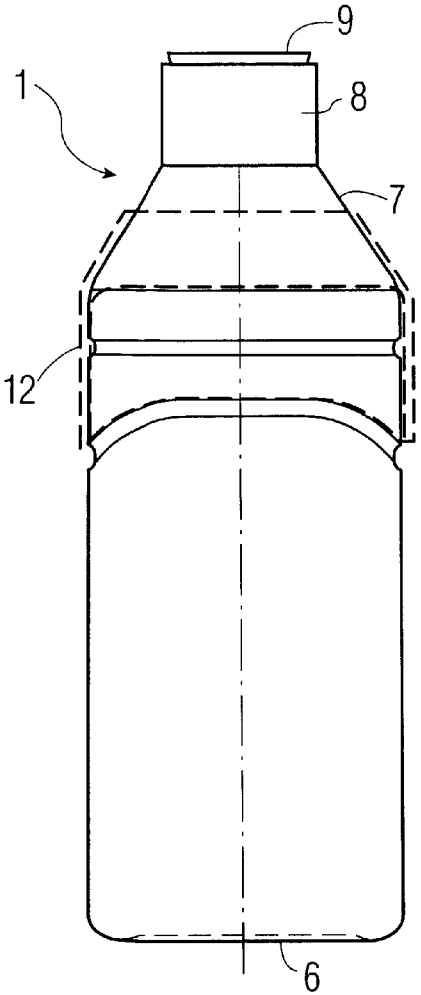
FIG. 1 is a front view of a packaging container according to the invention.

If the container 1 is not to be adhesively attached to a wall, an additional stand or a wall-mounted holder may be provided. A wall-mounted holder is shown in chain lines in FIGS. 1 to 3 and is denoted by the reference 12. The internal dimensions of the wall-mounted holder 12 and the external dimensions of the container 1 and, more particularly, the profiling 11 are selected so that the container 1 engages in, i.e snaps into, the annular wall-mounted holder 12. The wall-mounted holder 12 itself can be bonded to the associated wall surface or fixed to the wall by means of screws or the like. Use of the wall-mounted holder 12 affords the additional advantage that the packaging container 1 is easy to replace when empty. The shape of the container 1 and the corresponding inner shape of the wall-mounted holder 12 ensure accurate, non-rotatable positioning of the packaging container 1 in the wall-mounted holder 12. The engagement of the container in the wall-mounted holder 12 affords psychological protection against theft because a certain resistance has to be overcome in order to install and remove the container 1.

The rounded shape of the front wall 5 and the straight side walls 3 and 4 provide for an optimal decorative surface visible from all three sides.

As can best be seen from FIG. 3, the closure 8 is preferably asymmetrical, i.e. situated relatively far from the wall, to guarantee the satisfactory removal of product.

Although various embodiments of the invention have been shown and described, they are not meant to be limiting. Those of skill in the art may recognize certain modifications to these embodiments, which modifications are meant to be covered by the spirit and scope of the appended claims. Thus, combination with a stand is of course also possible, etc.

What is claimed is:

1. A container for packaging liquid products, and for use in an upended position, comprising:

a closure for closing a dispensing opening of the container, which closure opens and closes automatically in response to changes in pressure in the container;

at least one flat side wall for attaching said container to a flat surface;

at least two concave or convex actuation surfaces, which are designed for the application of pressure by a hand of a user, which are formed in opposite side walls, respectively;

a front wall opposite said flat side wall, said front wall being partly cylindrical with a convex curvature;

said closure for said container consisting of a membrane closure;

said container being thinner in the vicinity of the actuation surfaces than elsewhere, thereby reducing the force required to depress the container wall to a level not causing any substantial deformation of the container; and said container having a rectangular cross-section except for said front wall.

2. A container as claimed in claim 1, wherein the container further includes encircling profiles for insertion into a wall mounted holder or a stand.

* * * * *